United States Patent [19]

Cline

[11] 4,389,060

[45] Jun. 21, 1983

[54] TABBED POCKET FOR USE IN RING BINDER AND WIRE BOUND BOOKS

[76] Inventor: Robert C. Cline, Washburn Rd., Saugerties, N.Y. 12477

[21] Appl. No.: 231,418

[22] Filed: Feb. 4, 1981

[51] Int. Cl.[3] ..... B42B 5/12; B42D 13/00; B42F 21/02

[52] U.S. Cl. ..... 281/38; 281/31; 283/38; 283/40; 283/42; 402/79

[58] Field of Search ..... 402/79, 80 R, 80 L; 281/31, 38; 283/36–42; 282/11.5 A

[56] References Cited

U.S. PATENT DOCUMENTS

| | | | |
|---|---|---|---|
| 3,201,146 | 8/1965 | Tilton, Jr. | 281/31 |
| 4,244,660 | 1/1981 | Aronson | 281/31 |

FOREIGN PATENT DOCUMENTS

| | | | |
|---|---|---|---|
| 510988 | 1/1931 | Fed. Rep. of Germany | 281/38 |
| 1012860 | 7/1952 | France | 283/40 |
| 332119 | 7/1930 | United Kingdom | 281/31 |

OTHER PUBLICATIONS

Top Scholar ® Four Subject Pocket Note Book, sold by Top Scholar Corp., Columbia, Md.

Kodak ® Master Darkroom Data Guide—1968.

*Primary Examiner*—Paul A. Bell

*Attorney, Agent, or Firm*—Hopgood, Calimafde, Kalil, Blaustein & Judlowe

[57] ABSTRACT

This book is made in sections with blank pages of each section divided from those of other sections by separators that are made of heavier paper than the blank pages of the sections. The separators have tabs extending from the vertical edges of the separators and for limited portions of the height of the vertical edges of each of the separators at the upper portions of the vertical edges. Pockets are formed by panels of the separators, the pockets preferably being formed on opposite sides of each separator. The pockets are wider than the horizontal width of the pages so that pages torn from the book between separators can be placed in the pockets, preferably without folding the pages.

1 Claim, 8 Drawing Figures

TABBED POCKET FOR USE IN RING BINDER AND WIRE BOUND BOOKS

BACKGROUND AND SUMMARY OF INVENTION

In the preferred construction, the pockets have blank areas of the tabs for indexing the material noted on the pages between the separators, and surfaces of the pockets that face away from the separators have areas on which the notes can be written to indicate the contents of the pockets.

The pages and the separators are preferably bound by rings, wire or other mechanical binding that permits the book to be opened so as to lie flat with the pages and separators in the same plane when the book is open wide and pages and separators are in substantially the same plane.

Ring or mechanical binding preferably extend through openings in the pages and the separators so that pages that have been written on can be conveniently marked with a pen or pencil or torn from the book and placed in an adjacent pocket so that pages can be rearranged in any sequence for binding the pages together in any desired order.

Other objects, features and advantages of the invention will appear or be pointed out as the description proceeds.

BRIEF DESCRIPTION OF DRAWING

In the drawing, forming a part hereof, in which like reference characters indicate corresponding parts in all the views;

FIG. 3 is a separator which is used to separate groups of pages from one another, each group being a theme section;

FIG. 4 is a view showing the book of FIG. 1 in an open position;

FIG. 5 is a fragmentary view of the vertical edge of the second separator of the book shown in FIG. 4;

FIG. 6 is a fragmentary view of the vertical edge of the third separator;

FIG. 7 is a similar view of the fourth separator, the book shown in FIG. 4 having only four separators with vertical dimensions which use approximately the upper half of the separators, but if tabs of lesser vertical height are used more separators can be employed; and FIG. 8 is an enlarged sectional view taken on the line 8—8 of FIG. 4.

DESCRIPTION OF PREFERRED EMBODIMENTS

Figure 1:
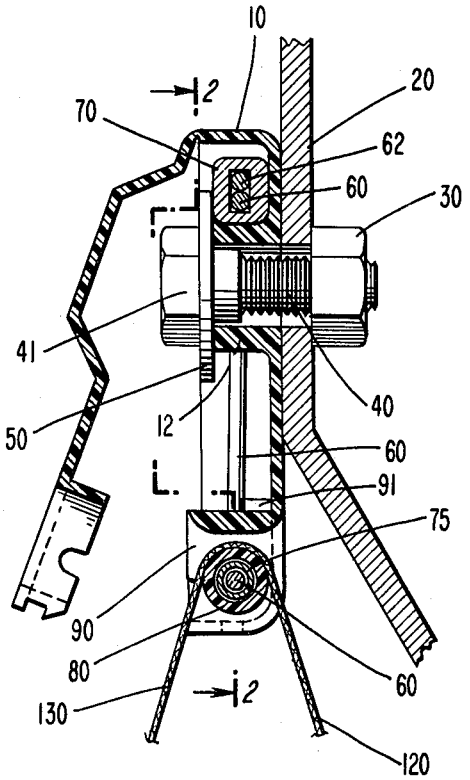
FIG. 1 is a diagrammatic view of a mechanically bound book with the pages held in assembled relation by rings that open up to pass through holes near one of the vertical edges of the book, commonly referred to as a "three-ring binder"

FIG. 1 shows a book 10 which is preferably a blank book with a front cover 12 and a back cover 14 enclosing pages 16. The pages 16 are ordinary writing paper and they are held in the book by the binding mechanism 18 which may be a loose-leaf ring metal or it may be any wire binding device having two or more rings which extend through openings 20 as shown in FIG. 3. In FIG. 1 there are separators 22 which are made of heavier paperboard than the pages 16 and these separators 22 are wider than the horizontal width of the pages 16 and each of the separators has a tab 24.

The book has a number of pages for writing on for a selected theme. The book 10 shown in FIG. 4 has a group of pages 16 which are turned forward over the front cover 12 until the first separator 22 is reached and the separator has a tab 24 which is a continuation of 22.

There is a pocket 28 which is secured to the front of the separator 22 below a top edge 30 of the pocket 28. The heavy paper sheet which covers the lower part of the separator 22 beginning at the line 30 is formed into a pocket by having an upwardly folded edge 32 at a bottom mid-location. The pocket at the location 30 has no connection with the full height of the separator but the edge of the separator at the folded edge 32 is adhered to the panel 22 of the separator in the same way as the panel 32 is folded up and secured to the main separator panel 22.

Referring again to FIG. 1, there are other pages of ordinary writing paper 36 which are located behind the main panel of the separator 22 and these pages 36 fill the space between the separator 22 and a separator 38. The construction of the pocket below the mid-location 30 in FIG. 4 is of similar construction as shown in FIG. 5 where the pocket begins at the horizontal line 40 and there is a tab 44 which extends beyond the vertical edges of the paper 36 in the same way as described in FIG. 4. A tab 46 (corresponding to tab 32 in FIG. 4) extends horizontally to form a partial bottom for the pocket and a vertically extending tab 48 (corresponding to tab 34 in FIG. 4) forms the closed vertical end of the pocket which starts at the upper edge 40.

The description thus far has pockets covering the lower half of each of the separators 22, 38, **38*a* and 38*b*, and it will be seen that each of the separators has a pocket on its rearward side which is identical in construction with those on the forward side, the sheets forming the pockets being outside the lower portion of the separators 22, 38, 38*a* and 38*b***, the pocket sheets respectively confronting both the front face and the rearward face of the separators.

FIG. 8 shows separator panel 22 as the middle sheet, whereby front sheet 28 and panel 22 define the front pocket, and whereby rear sheet 32' and panel 22 define the rear pocket, both pockets being of such width as to accommodate insertion of unfolded sheets 36 that have been removed from the binding.

The preferred embodiments of the invention have been illustrated and described, but changes and modifications can be made and some features can be used alone or in different combinations without deparating from the invention as defined in the claims.

What is claimed is:

1. A loose-leaf book comprising front and back covers, a filler between said covers and comprising page sheets and a plurality of divider sheets interposed between successive groups of page sheets, said page sheets and said divider sheets having registering perforations on an alignment between upper and lower edges of the sheets and at marginal offset from a common binding lateral edge, and an array of wire-loop formations extending through the registering perforations and binding said filler between said covers; said divider sheets having index-tab formations extending outward from the lateral edge opposite the binding edge to an extent at least equal to the bound marginal offset of said perforations from said binding edge, and said index-tab formations being distributed along substantially the upper half of the lateral edge opposite the binding edge; front and back pocket-sheet panels enclosing substantially the lower half of each divider sheet to substantially the full extent of index-tab projection and edge binding, said pocket-sheet panels having edge-binding perforations which register with corresponding perforations of the associated divider sheet and being bound by said loop formations, a bent closure of front and back pocket-sheet panels to each other at the lower edge of the associated divider sheet, and a bent closure of said front and back pocket-sheet panels to each other at the lateral edge alignment of the index-tab formation of the associated divider sheet; whereby a page sheet removed from edge-bound relation to said book may, without folding, be insertably received in either of the pockets of each divider sheet, without interfering with the bound relation of remaining page and divider sheets of said filler.

* * * * *

UNITED STATES PATENT AND TRADEMARK OFFICE

CERTIFICATE OF CORRECTION

PATENT NO. : 4,389,060

DATED : June 21, 1983

INVENTOR(S) : Robert C. Cline

It is certified that error appears in the above-identified patent and that said Letters Patent is hereby corrected as shown below:

The title page should be deleted to appear as per attached title page.

The sheet of drawing should be deleted to appear as per attached sheet.

Signed and Sealed this

*Fourth* Day of *October 1983*

[SEAL]

*Attest:*

GERALD J. MOSSINGHOFF

*Attesting Officer*

*Commissioner of Patents and Trademarks*

United States Patent [19]
Cline

[11] 4,389,060
[45] Jun. 21, 1983

[54] TABBED POCKET FOR USE IN RING BINDER AND WIRE BOUND BOOKS

[76] Inventor: Robert C. Cline, Washburn Rd., Saugerties, N.Y. 12477

[21] Appl. No.: 231,418

[22] Filed: Feb. 4, 1981

[51] Int. Cl.³ ..... B42B 5/12; B42D 13/00; B42F 21/02

[52] U.S. Cl. ..... 281/38; 281/31; 283/38; 283/40; 283/42; 402/79

[58] Field of Search ..... 402/79, 80 R, 80 L; 281/31, 38; 283/36–42; 282/11.5 A

[56] References Cited

U.S. PATENT DOCUMENTS

| | | | |
|---|---|---|---|
| 3,201,146 | 8/1965 | Tilton, Jr. | 281/31 |
| 4,244,660 | 1/1981 | Aronson | 281/31 |

FOREIGN PATENT DOCUMENTS

| | | | |
|---|---|---|---|
| 510988 | 1/1931 | Fed. Rep. of Germany | 281/38 |
| 1012860 | 7/1952 | France | 283/40 |
| 332119 | 7/1930 | United Kingdom | 281/31 |

OTHER PUBLICATIONS

Top Scholar ® Four Subject Pocket Note Book, sold by Top Scholar Corp., Columbia, Md.
Kodak ® Master Darkroom Data Guide—1968.

*Primary Examiner*—Paul A. Bell
*Attorney, Agent, or Firm*—Hopgood, Calimafde, Kalil, Blaustein & Judlowe

[57] ABSTRACT

This book is made in sections with blank pages of each section divided from those of other sections by separators that are made of heavier paper than the blank pages of the sections. The separators have tabs extending from the vertical edges of the separators and for limited portions of the height of the vertical edges of each of the separators at the upper portions of the vertical edges. Pockets are formed by panels of the separators, the pockets preferably being formed on opposite sides of each separator. The pockets are wider than the horizontal width of the pages so that pages torn from the book between separators can be placed in the pockets, preferably without folding the pages.

1 Claim, 8 Drawing Figures

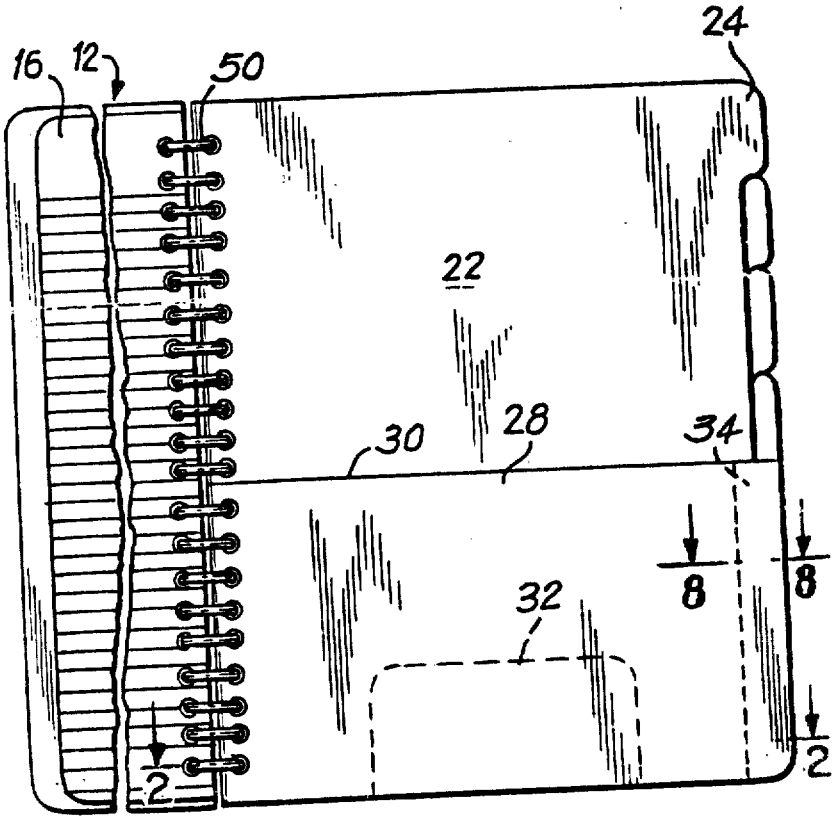

Figure 2:
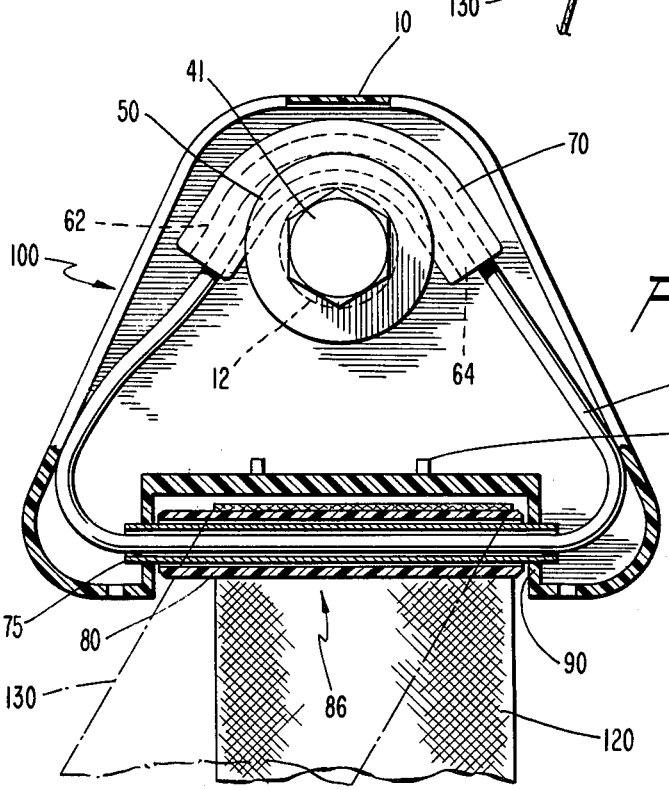
FIG. 2 is a sectional view, partly broken away, taken on the section line 2—2 of FIG. 4.

FIG. 1
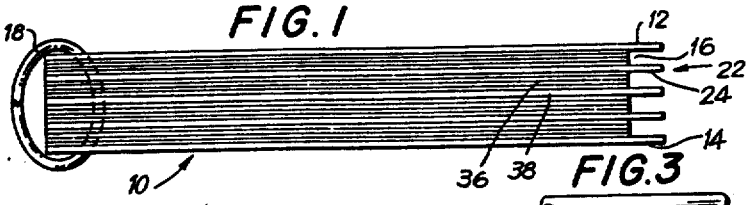
FIG. 3
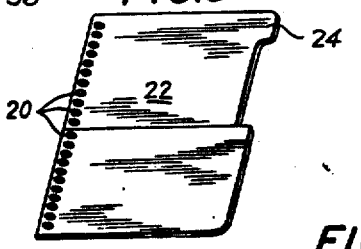
FIG. 4
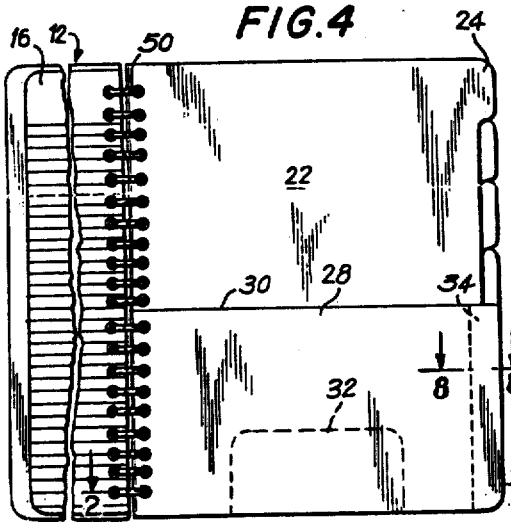
FIG. 5
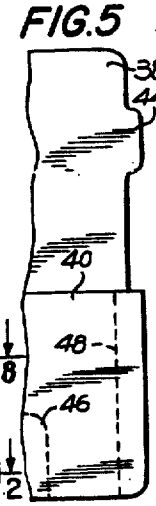
FIG. 6
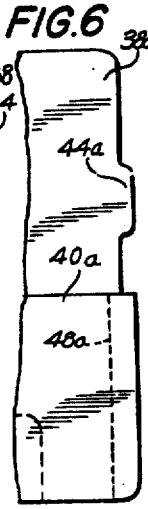
FIG. 7
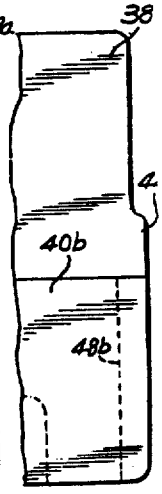
FIG. 8
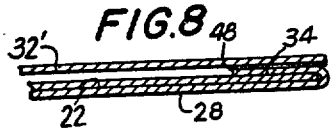
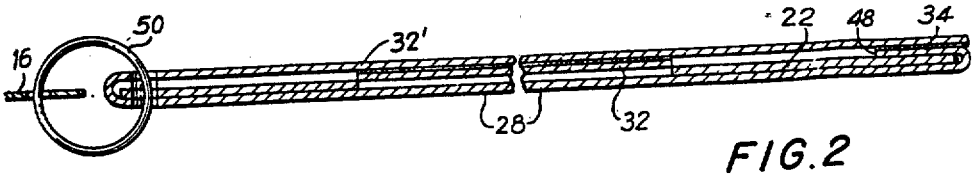
FIG. 2